United States Patent [19]

Yao et al.

[11] Patent Number: 4,950,382

[45] Date of Patent: Aug. 21, 1990

[54] PROCESS FOR IMPROVING THE LOW TEMPERATURE PERFORMANCE OF DEWAXED OIL AND FORMULATED OIL PRODUCTS

[75] Inventors: Kieth C. Yao; Michael A. Fefer, both of Sarnia, Canada

[73] Assignee: Exxon Research & Engineering Company, Florham Park, N.J.

[21] Appl. No.: 14,582

[22] Filed: Feb. 13, 1987

[51] Int. Cl.[5] ..... C07C 7/13

[52] U.S. Cl. ..... 208/28; 208/33; 208/99; 208/310 Z

[58] Field of Search ..... 208/28, 58, 33, 99, 208/182, 199, 301, 310 Z, 307, 87

[56] References Cited

U.S. PATENT DOCUMENTS

| | | | |
|---|---|---|---|
| 2,384,315 | 9/1945 | Kuhl | 196/44 |
| 2,908,039 | 10/1959 | Carter et al. | 208/307 |
| 2,926,135 | 2/1960 | Engel et al. | 208/306 |
| 3,014,860 | 12/1961 | Douwes et al. | 208/254 |
| 3,224,955 | 12/1965 | Anderson | 208/28 |
| 3,232,803 | 2/1966 | Watson et al. | 208/87 X |
| 3,243,366 | 3/1966 | Kimberlin, Jr. et al. | 208/28 |
| 3,462,358 | 8/1969 | Mills et al. | 208/14 |
| 3,654,128 | 4/1972 | Woodle | 208/33 |
| 3,765,152 | 8/1973 | Gulick | 208/307 |
| 3,849,298 | 11/1974 | Funakubo et al. | 208/310 |
| 4,081,352 | 3/1978 | West et al. | 208/33 X |
| 4,181,598 | 1/1980 | Gillespie et al. | 208/87 X |
| 4,367,364 | 1/1983 | Kulprathipanja et al. | 585/826 |
| 4,404,118 | 9/1983 | Herskovits | 252/411 |
| 4,423,278 | 12/1983 | Yang et al. | 585/823 |
| 4,448,071 | 5/1984 | Dessau | 208/310 Z |
| 4,455,444 | 6/1984 | Kulprathipanja et al. | 208/310 Z |
| 4,487,668 | 12/1984 | Dessau | 208/310 Z |
| 4,622,130 | 11/1986 | Stem | 208/33 |

*Primary Examiner*—Glenn Caldorola

*Attorney, Agent, or Firm*—Joseph J. Allocca

[57] ABSTRACT

Dewaxed oils can have their low temperature performance improved by the removal of residual wax by adsorption of said residual wax onto a hydrophobic molecular sieve. The wax-laden hydrophobic molecular sieve is regenerated by use of dewaxing solvents, such as ketones.

The dewaxed oils, which have residual wax removed by the present invention, are oils which have been dewaxed by means of solvent dewaxing procedures or by catalytic dewaxing processes. These oils, produced by the combination of conventional-adsorptive trim dewaxing, exhibit superior formulated oils low temperature performance as compared to formulated oils made from oils dewaxed to the same pour point solely by conventional dewaxing by either solvent or catalytic processes practiced under severe conditions (deep dewaxing).

16 Claims, 3 Drawing Sheets

ADSORBENT TREATING PROCESS FOR IMPROVING THE LOW TEMPERATURE PERFORMANCE OF LUBE BASESTOCKS

PROCESS FOR IMPROVING THE LOW TEMPERATURE PERFORMANCE OF DEWAXED OIL AND FORMULATED OIL PRODUCTS

BACKGROUND OF THE INVENTION

Waxy oils, preferably waxy petroleum oils, more preferably waxy lube or specialty oil, such as transformer, refrigerator, electrical, white oil, etc., which have been dewaxed by means of conventional solvent dewaxing process or catalytic dewaxing processes in most instances contain residual quantities of wax. Lube oils are typically dewaxed to a pour point of about −3° C. to −15° C., while speciality oils require even lower pour points (e.g., for transformer oil −39° C. maximum). The wax is detrimental to the oil as it can impart haze to the oil, detracting from its visual appeal, but, more importantly, the presence of residual wax can impair performance, especially at low temperatures. Traditionally, waxy oils are deeply dewaxed so as to minimize the quantity of residual wax present in the final dewaxed oil product. This deep dewaxing, be it by solvent dewaxing or catalytic dewaxing, has associated with it not insignificant cost and throughput disadvantages due to the necessity of conducting the conventional dewaxing process, be it solvent dewaxing or catalytic dewaxing, under severe conditions.

DESCRIPTION OF THE INVENTION

Figure 1:
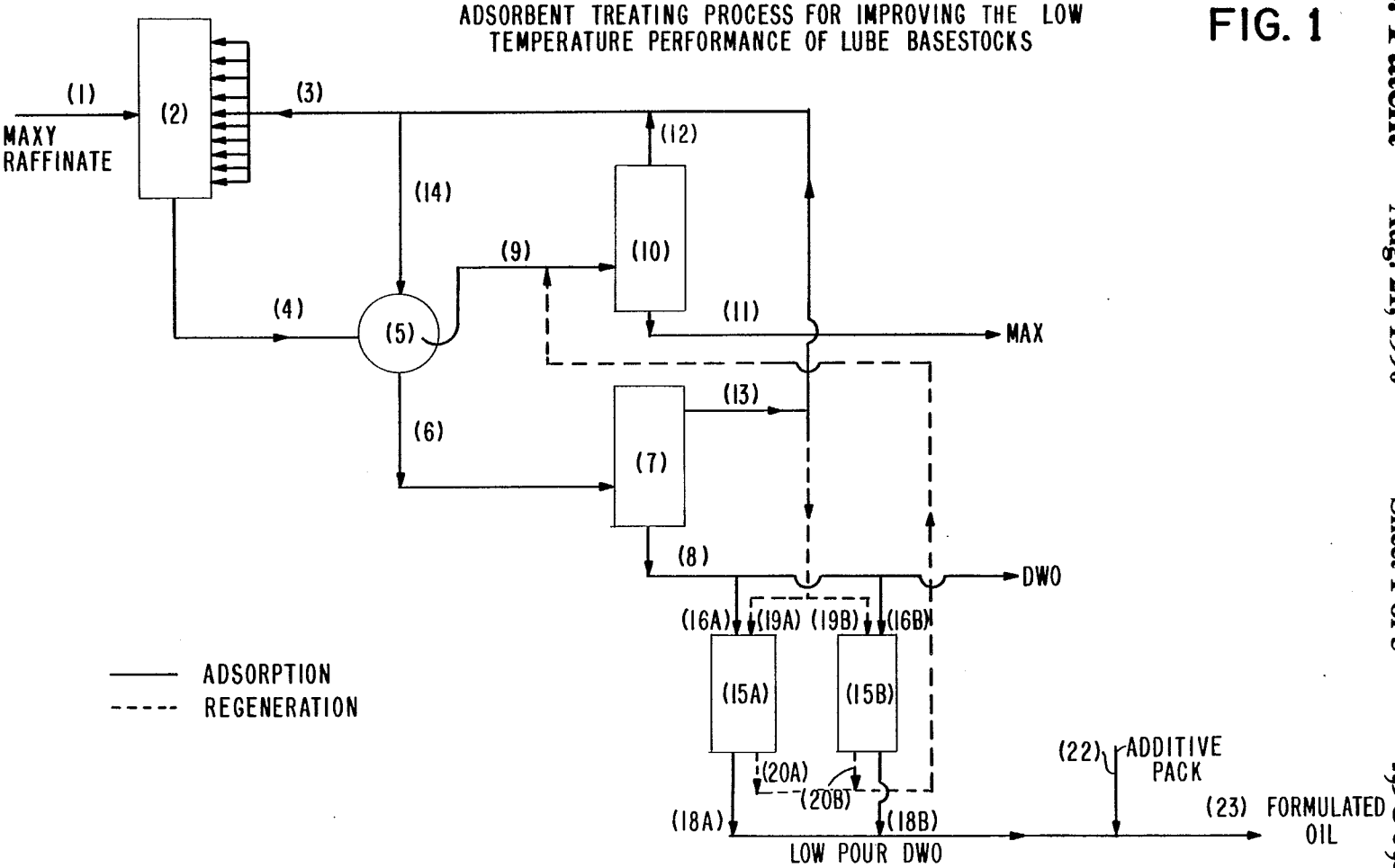
FIG. 1 is a schematic of a dewaxing process employing an adsorbent treating process to improve low temperature performance of solvent dewaxed lube basestocks and formulated oil products.

In the present invention waxy oils which have been traditionally dewaxed to conventional pour points in the order of about −3° C. to −10° C. as by standard condition solvent or catalytic dewaxing processes (as to differentiate from deep dewaxing procedures employing more severe conditions) can have the residual wax removed and thereby be deeply dewaxed to pour points on the order of −12° C. to −20° C. or more for typical lube basestocks and −12° C. to −40° C. for speciality oils, such as transformer oils by adsorption of the residual n-paraffin wax from the oil onto a hydrophobic molecular sieve adsorbent. Any dewaxed oil can be the feed to this adsorptive trim dewaxing process, including any natural hydrocarbon or petroleum or synthetic oil product which is dewaxed in order to be used in commercial applications. Hydrophobic molecular sieve adsorbents, such as silicalite, exhibit preference for the adsorption of normal and near-normal paraffin waxes.

When these adsorptive process deeply dewaxed oils are formulated by combining with standard quantities of typical lube oil add-pack materials, the resulting formulated oil product exhibits performance superior to that of essentially similar oils which had been deeply dewaxed to equivalent pre-formulated pour points.

Additive packages are generally used in the production of finished oil products, such as engine lubricating oils, greases, turbine oils, refrigerator oils, etc. to impart to the oils enhanced performance characteristic, e.g., lower depressed cloud and pour points, higher VI, greater oxidation stability. A typical lube oil add-pack will contain detergent/inhibitor components, VI improvers and pour point depressants. The components which go into add-packs and the quantity used per volume of oil treat are familiar to those skilled in the art and vary from oil manufacturer to oil manufacturer, depending on the particular desired performance characteristic desired for the finished oil products. The amount of additives added to typical oils to produce different formulated oil products is recited in Table I.

TABLE I

TYPICAL PRODUCT FORMULATIONS

| | Product | | | | | | |
|---|---|---|---|---|---|---|---|
| | Heavy Duty Engine Oil | Passenger Engine Oil | Circulation Oil | Gear Oil | Hydraulic Oil | Railway Oil | Transformer Oil |
| Adpack Additives, LV %(1) | | | | | | | |
| Detergent/Inhibitors | 4.2–13.0 | 3.6–14.0 | 0.1–0.2 | 0.1–0.3 | 0.1–0.3 | 10–13 | 0–0.6 |
| VI Improvers | 4.2–14.0 | 8.0–14.0 | <10 | 2–30 | 2–30 | 1–2 | — |
| Pour Depressant | 0.1–0.5 | 0.1–0.5 | 0.1–0.5 | 0.1–0.5 | 0.1–0.5 | 0.1–0.5 | 0–1.0 |

(1)Based on Formulated Oil

Therefore, a process is described for the production of base oils and formulated oils of superior performance comprising the steps of conventionally dewaxing a waxy hydrocarbon oil to a conventional pour point of between about −3° C. to −10° C., deeply dewaxing said oil from the conventional step by trim dewaxing, consisting of contacting said oil with a hydrophobic molecular sieve adsorbent to a pour point of between about −12° C. to −40° C., and combining the deeply dewaxed oil with an effective amount of an additive pack to produce a formulated oil product.

A hydrophobic molecular sieve is a crystalline adsorbent having uniform pore diameter and low affinity for polar material. Silicalite is just one of this type of adsorbent (the pore diameter is about 6 Å units and its pore volume is 0.19 cc/gm and particle density is about 1.4 g/cc). Silicalite is described in detail in U.S. Pat. No. 4,104,294 and U.S. Pat. No. 4,061,724 and in "Silicalite, a New Hydrophobic Crystalline Silica Molecular Sieve", Flanigan, et al., *Nature,* Volume 271, February, 1978, page 512–516. The use of silicalite to remove a specific n-paraffin from mixtures of the same with branched and cyclic paraffins is demonstrated in U.S. Pat. No. 4,455,444. Any non-polar, non-acidic sieving material can probably be considered a hydrophobic molecular sieve. This includes zeolites, as well as non-zeolite materials (i.e., carbon molecular sieve). However, there is a narrow range of pore opening (5–7 Å) considered to be useful for separating wax molecules from lube oils.

It is believed that it is possible to convert hydrophilic zeolite into the hydrophobic form by physical or chemical means, such as silination, steam treatment to remove —OH groups, dealumination to increase silica/alumina ratio and neutralizing acid groups with base, etc.

This adsorption step of the present process comprises contacting from 1 to 50 weight units of conventionally dewaxed oil per weight unit of adsorbent, preferably 1 to 20 weight units of oil per weight unit of adsorbent.

Single pass or multi-pass contacting can be employed, or multiple adsorption zones, depending on the final target pour point desired.

This contacting is performed at between about 25° C. to 250° C., preferably 50° C. to 200° C.

Temperature may affect wax adsorption in two different ways: a higher temperature is favorable if adsorption is rate limited, but too high a temperature can also cause cracking/coking, which is undesirable. A lower temperature may benefit the adsorbent capacity. The upper temperature limit is typically set by the temperature of the solvent dewaxed oil feed recovered from the oil/solvent recovery unit of the conventional dewaxing unit.

Contacting is also performed at any convenient pressure sufficient to maintain the system in liquid phase, such as at atmospheric pressure to about 250 psig, preferably 20 to 150 psig for from 15 to 120 minutes.

Longer contact time benefits adsorption of wax from oil feed in a batch mixing operation; 1 to 2 hours is sufficient, a higher temperature can reduce the contact time required. While diluent may be required for batch operation, it is not necessary for a flow system in which 0.2 to 2 LHSV, preferably 0.5 to 1.0 LHSV, is employed. Percolation of oil feed through a fixed bed of adsorbent is the preferred practice.

After adsorption the wax-laden adsorbent is separated from the dewaxed oil, the adsorbent is washed to remove/recover any trapped oil and the adsorbent regenerated.

$N_2$, other inert gas, such as Group Zero noble gas, or steam purge can be used for removing oil trapped in the adsorbent bed. Steam purge is preferred.

Temperature and pressure used in purge are the same as that used in the adsorption step. Amount of purge steam may not be critical, just enough being employed to remove the trapped oil.

Regeneration is performed by employing a dewaxing solvent to strip the wax from the adsorbent. The dewaxing solvents employed in this regeneration step can be selected from ketones, alcohols, ethers and mixtures thereof.

In general, dewaxing solvent having a kinetic molecular diameter smaller than the pore diameter of adsorbent (i.e., silicalite) can be used as desorbent. For example, propane, methyl ethyl ketone (MEK) and linear paraffins are effective for removing wax molecules from silicalite adsorbent. Propane and MEK are preferred solvents because the process is preferably integrated with conventional solvent dewaxing processes in which propane and MEK are being used as dewaxing solvents.

Dewaxing solvent is used at a solvent to adsorbent weight ratio of 10 to 1, preferably 5 to 1.

The dewaxing solvent and adsorbent are contacted at a temperature of about 25° C. to 250° C., preferably 50° C. to 150° C., the minimum temperature employed being at least enough to liquefy the wax. Contacting can be under reflux, circulation or static conditions.

Circulation of dewaxing solvent over the saturated adsorbent bed is the preferred method. Pressure ranging from 20–150 psig may be used to maintain the dewaxing solvent in liquid state at desorption temperature. Regeneration time should match the time used in adsorption step. Exact time required for a fixed-bed regeneration depends on the temperature used. In general, 1–2 hours is sufficient.

The wax-free adsorbent is separated from the wax-laden dewaxing solvent by settling/decantation, filtration, centrifugation, etc.

In a flow system, which is preferred in this invention, the wax-laden dewaxing solvent is preferably pumped out from the regenerated adsorbent.

The regenerated adsorbent is then dried prior to the next adsorption cycle.

Hot inert gas (i.e., nitrogen) or steam purge is suggested to remove as much as possible of the amount of desorbent trapped in the adsorbent bed. Residual desorbent, adsorbed in micropores of adsorbent, can be displaced with dewaxed oil feed from the next adsorption run, if necessary the adsorbent trim dewaxed product from the beginning of a run over regenerated adsorbent containing some solvent can be recycled to oil/solvent recovery unit in the main solvent dewaxing process or sent to a small, separate stripping unit to remove the small amount of residual solvent.

The regeneration dewaxing solvent (desorbent) can be separated from the wax by simple distillation or other separation techniques, such as membrane permeation or even refrigeration to precipitate the wax from the solvent, followed by filtration.

The adsorption step of the present invention is integrated into a solvent dewaxing process, as in such a process solvent handling and regeneration processes and equipment are already in place and can be readily used to regenerate the dewaxing solvent employed in regenerating the adsorbent.

Conventional dewaxing processes include solvent dewaxing processes and catalytic dewaxing processes. Waxes can be removed from waxy hydrocarbon oils by chilling the oil to precipitate out the wax and then separating the solid wax particles from the dewaxed oil by liquid/solid separation procedures such as filtration, centrifugation, settling, etc. Industrial dewaxing processes include press dewaxing processes wherein the wax-containing oil, in the absence of solvent, is chilled to crystallize out the wax particles which are then pressed out on a filter. In general, only light hydrocarbon oil fractions are treated by press dewaxing due to viscosity limitations. More typical are solvent dewaxing processes wherein a waxy oil is mixed with a solvent and then chilled to precipitate the wax as tiny particles or crystals thereby forming a slurry comprising solid wax particles and a solution of dewaxed oil containing dewaxing solvent. The slurry is fed to a wax separator (e.g. filter, centrifuge, etc.) wherein the wax is removed from the dewaxed oil and dewaxing solvent. Solvent dewaxing processes are used for heavier oil fractions such as lubricating oil fractions and bright stocks Typical dewaxing solvents include low boiling point, normally gaseous autorefrigerative hydrocarbons such as propane, propylene, butane, pentane, etc., ketones such as acetone, methyl ethyl ketone (MEK), methyl isobutyl ketone (MIBK) and mixtures thereof, aromatic hydrocarbons such as benzene, toluene, and xylenes as well as mixtures of ketones and aromatic hydrocarbons such as MEK/toluene and acetone/benzene, as well as mixtures of ketones with autorefrigerants such as acetone/propylene.

Solvent dewaxing can be practiced utilizing either indirect chilling means wherein solvent is mixed with the waxy oil and then the mixture chilled by indirectly contacting same in a heat exchange (as exemplified by the double walled scraped surface chiller, or direct chilling means wherein cold solvent is added to the waxy oil, thereby to precipitate out the wax.

Preferred direct chilling means employing cold solvent injected along a number of stages therein, a number of which stages are highly agitated to insure relative instantaneous mixing, is DILCHILL$^R$ dewaxing, a process described in U.S. Pat. No. 3,773,650. A variation in this process involves following chilling in the direct chilling means with additional chilling in indirect chillers, e.g. in scraped surface chillers; this combination is embraced by U.S. Pat. No. 3,775,288.

Catalytic dewaxing is also a process becoming more widespread. In such processes, the waxy oil is contacted in the presence of hydrogen and at elevated temperatures and pressures with catalytic materials, which selectively crack the waxy molecules to lower molecular weight species. Such catalyst include, for example, mordenite, and zeolites such as the ZSM type materials. Catalytic dewaxing processes are described in U.S. Pat. Nos. 3,647,681; 3,700,585; 3,894,938; 3,968,024; 4,181,598; 4,259,174. The combination of solvent dewaxing/catalytic dewaxing is described in U.S. Pat. No. 3,755,138.

It is usual in the commercial practice of dewaxing processes for the oil to be dewaxed to a pour point of about −3° to −15° C. To go much beyond these pour points by solvent dewaxing involves utilizing solvents of such low temperature or employing such increased volumes of solvent as to be of limited practical commercial use, being employed only on rare occasions and only if absolutely necessary. Even in catalytic dewaxing, dewaxing down to a pour point much below −10° C. could involve significant loss of valuable oil molecules which could be cracked by exposure of the catalyst at the more severe condition of temperature, pressure or exposure time needed to achieve the low pour points.

By the practice of the present invention waxy oils are dewaxed by conventional solvent or catalytic means down to the practical commercial limit of those procedures, i.e. down to a pour point of about −3° to −12° C. Lower pour points are achieved by removing additional quantities of wax by selective adsorption of the waxy hydrocarbon particles (particularly the waxy n-paraffins) from the oil onto hydrophobic adsorbents, such as silicalite.

The resulting oil possessing pour points between −12° C. to −40° C. produced by adsorptive trim dewaxing are superior to oils of comparable pour point produced by conventional procedures practiced under more severe conditions. Reference to the data in Example 4 shows that adsorbent trim dewaxed oil, compared to deeply dewaxed oil produced by solvent dewaxing (both oils possessing pour points of −12° C.) when formulated with the same additive packages exhibited superior low temperature performance, indicating a fundamental superiority of the oils produced by the process of conventional dewaxing/adsorptive-trim dewaxing as compared to oils of equivalent pour point produced by deep dewaxing using conventional procedures under more severe conditions.

These superior oils, when formulated with additive packages typically utilized in the industry to impart certain desirable characteristics to the oils for commercial application, exhibit in their formulated form superior low temperature properties as compared to oils formulated with the same adpacks and of the same pour point but which achieved that pour point by conventional processes (such as solvent dewaxing) under severe condition.

Additive packages are usually employed to impart enhanced depressed cloud point, depressed pour point, improved oxidation stability, etc. of the oils. The use of adpacks is widespread in the oil industry with producers of formulated oils using in many instance, adpacks available from commercial adpack suppliers or, in the alternative, utilizing specialty proprietary adpacks of their own formulation. Regardless of the nature of the adpack utilized, however, when formulated with oils produced using conventional dewaxing-adsorptive trim dewaxing, the resulting product is one of superior performance.

The detailed description of the dewaxing process follows the flow plan shown in FIG. 1. Waxy feed (1) enters a DILCHILL$^R$ (a registered service mark of Exxon Research and Engineering Company) tower (2) where it is contacted with chilled solvent (3). The chilled solvent/feed slurry (4) is sent to vacuum filters (5). Filtrates (6) from this operation are sent to oil/solvent recovery unit (7) where partially solvent dewaxed oil (DWO) exits via line (8). Wax cake from vacuum filter after washing with fresh solvent (14) exits via line (9) to wax/solvent recovery unit (10). Solvent from wax and dewaxed oil recovery units are combined and recycled to the process via lines (3) and (14). When deep dewaxing is required the partially solvent dewaxed oil (16A) or (16B) is fed to an adsorber (15A) or (15B) where it is contacted with a hydrophobic molecular sieve. The adsorbent treated low pour dewaxed oil exits the adsorber via line (18A) or (18B). The adsorption process involves a two-bed system with one bed adsorbing while the other is being regenerated. A slip stream of recovered solvent (19A) or (19B) is used as desorbent to regenerate the wax saturated adsorbent. The wax containing wash exits the adsorber via line (20A) or (20B) to the wax/solvent recovery unit (10). Thus, the recovery of desorbent from desorbate is integrated with the main solvent dewaxing operation. Additives typically employed in formulating oils, such as those used to produce finished lube oils, automatic transmission fluids, refrigerator oils, turbine oils, electrical insulating oils, etc. are added via line 22 in conventional quantities and a final oil product is recovered via line 23.

Example 1 - Adsorption of Wax

Figure 2:
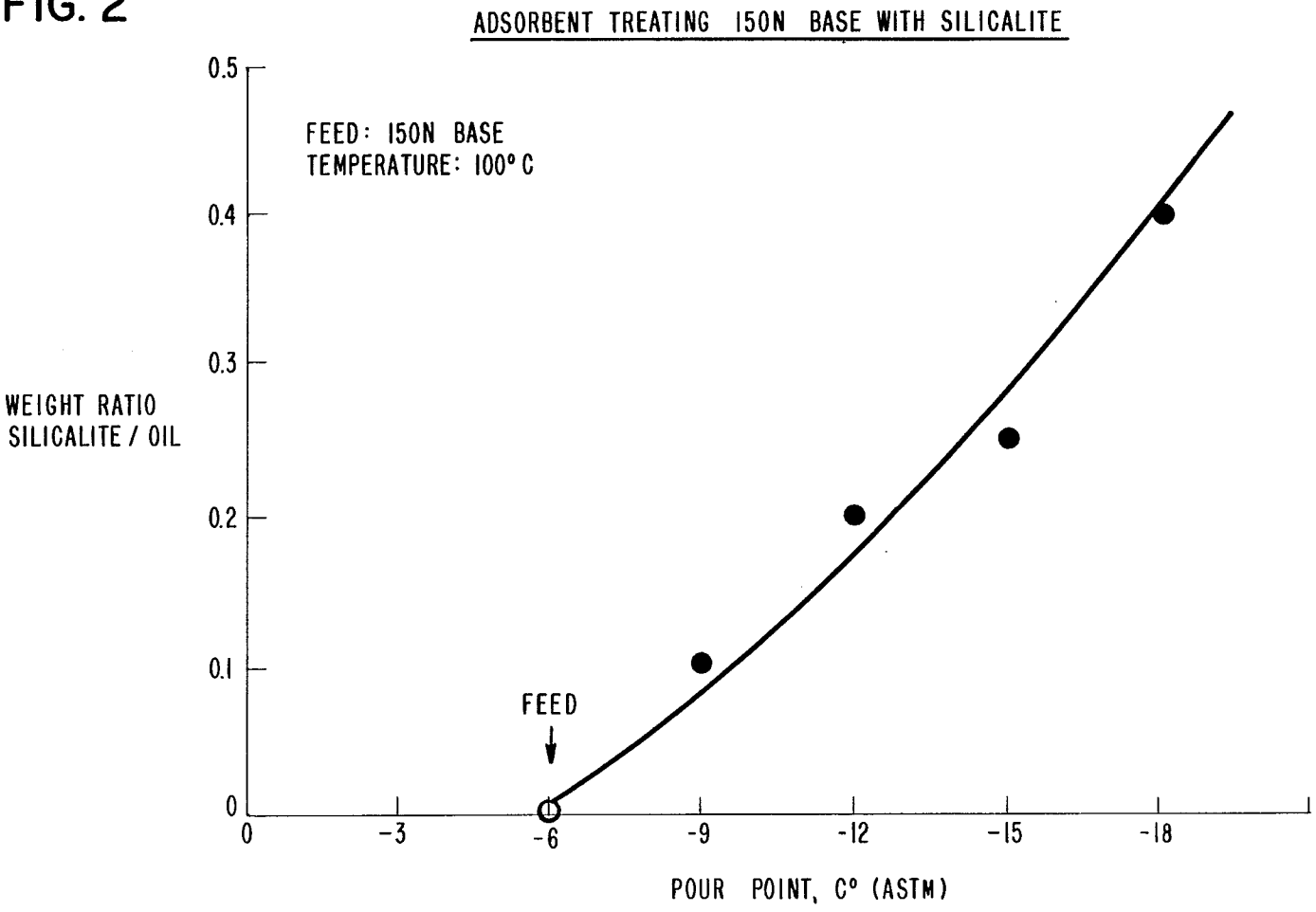
FIG. 2 shows the relationship between pour point of the oil and weight ratio of silicalite adsorbent to oil used to remove wax.

The effectiveness of Union Carbide silicalite, a hydrophobic molecular sieve (about 6 Å in micropore diameter) in removing residual wax from solvent dewaxed raffinate oil is shown in FIG. 2. Batch slurry testing results (on a once-through basis) showed that the reduction in oil pour point increased with increasing weight ratio of silicalite to oil. For example a ¼ weight ratio of silicalite to oil reduced the pour point of a 150 N dewaxed oil from −6° C. to −15° C. For comparison, the same oil was treated with conventional Union Carbide molecular sieve 5A under the same conditions. Pour point reduction was not observed with 1/5 to 1/3.3 weight ratio of adsorbent to oil in molecular sieve 5A treatment. Union Carbide molecular sieve 5A is a hydrophilic material of unit cell dimension 4.4Å and possessing a typical formula $Ca_5Na_2[(AlO_2)_{12}(SiO_2)_{12}]$.

Transformer oil has to meet a very low pour point specification (−39° C. maximum). Traditionally, it is made from non-waxy naphthenic distillate, thus, a dewaxing step is not required. However, there are big incentives to produce transformer oil from waxy paraffinic distillate. It has been proven that the production of very low pour base oil solely by deep solvent dewaxing is not only difficult to accomplish in commercial units, but also results in poor yield. We have found that silicalite is quite effective for lowering pour point of a partially solvent dewaxed paraffinic transformer oil base (−18° C. pour). Results shown in Table II indicate that the effect of silicalite treatment on pour point reduction is even more pronounced for transformer oil than 150 N dewaxed oil.

TABLE II

SILICALITE TREATING PARAFFINIC TRANSFORMER OIL BASE FOR POUR POINT REDUCTION

| | Feed[1] | | | |
|---|---|---|---|---|
| Silicalite/Oil, Wt. Ratio | — | 1/20 | 1/10 | ½ |
| Yield, Wt. % | — | 99.4 | 98.6 | 94.5 |
| Pour Point, °C. | −18 | −24 | −30 | −36 |
| Reduction in Pour Point, °C. | — | 6 | 12 | 18 |

80° C., 2 Hours Batch Slurry Mixing
[1]NMP extracted and ketone dewaxed Western Canadian VGO.
Extraction Conditions: NMP Treat = 80%, $H_2O$ 4%; Temperature, °C. (Top/Bottom) = 55/45
Dewaxing Conditions: Solvent/Oil = 2.5/1; MEK/MIBK, 50/50, −21° C. filter.

Example 2 - Regenerability of Silicalite

The wax saturated silicalite, after washing with isooctane to remove the trapped oil, was batch mixed at 80° C. under reflux with methyl-ethyl-ketone (MEK/silicalite weight ratio =5/1). The slurry was then filtered and the filtered silicalite was dried at 100° C. with air purge. The performance of the dried silicalite for was removal was evaluated with separate, fresh samples of the same oil and under the same conditions as that used in the first adsorption run. The results shown in Table III indicate that after 5 cycles (4 regenerations) performance of MEK regenerated silicalite for removing residual wax from a 150 N dewaxed oil (pour point = −6° C.) is essentially the same. It is interesting to note that the selectivity of silicalite for wax removal is very high since almost all adsorbed species are wax molecules.

TABLE III

REMOVAL OF RESIDUAL WAX WITH MEK REGENERATED SILICALITE

| | Cycle No. | | | | |
|---|---|---|---|---|---|
| | Feed* | 2 | 3 | 4 | 5 |
| | 150N solvent dewaxed stock | | | | |
| % Oil Recovered | — | 98.6 | 98.9 | 98.8 | 98.7 |
| RI at 75° C. | 1.4600 | 1.4603 | 1.4604 | 1.4605 | 1.4604 |
| Viscosity @ 40° C., cSt | 28.12 | 29.02 | 28.88 | — | 28.30 |
| Viscosity @ 100° C., cSt | 4.89 | 4.95 | 4.94 | — | 4.89 |
| VI | 94 | 91 | 91 | — | 92 |
| Pour Point, °C. | −6 | −9 | −9 | −9 | −9 |
| Wescan Cloud Point, °C. | −1 | −6 | −6 | −6 | −5 |

Adsorption Conditions: Silicalite/oil weight ratio = 1/5; slurry mixed at 100° C., for six hours.
Regeneration Conditions: 80° C., under reflux with MEK for 16 hours (MEK/silicalite weight ratio = 5/1). The filtered silicalite was then dried at 100° C., prior to being used in the next adsorption.
*The feed was phenol extracted and ketone dewaxed (to −6° C. pour) before being subjected to trim dewaxing with silicalite.
*Each run was performed on a fresh feed sample.

Example 3 - Comparison of Residual Wax Removed by Solvent Dewaxing and Silicalite Trim Dewaxing The above-mentioned 150N dewaxed oil was solvent (MEK/MIBK) dewaxed and silicalite trim dewaxed, respectively, to −15° C. pour. Samples of residual wax obtained from solvent deep dewaxing and that desorbed from silicalite were analyzed by capillary G.C. The results shown in Table IV indicate that in comparison with conventional solvent deep dewaxing processes, silicalite preferentially removes N-paraffins in trim dewaxing. More specifically, silicalite treating preferentially removes short-chain n-paraffins (Table 5).

TABLE IV

COMPARISON OF RESIDUAL WAX REMOVED BY SOLVENT DEWAXING AND SILICALITE TRIM DEWAXING

| | Weight % | |
|---|---|---|
| | Solvent (MEK/MIBK) | Silicalite |
| N-paraffins | 38.9 | 61.0 |
| 2-methyl | 9.2 | 6.6 |
| 3-methyl | 10.7 | 3.7 |
| 4+-methyl | 24.7 | 24.8 |
| Cyclo $C_6$ St | 5.4 | 0.4 |
| Cyclo $C_6$ Br | 11.1 | 3.6 |

TABLE V

DISTRIBUTION OF N-PARAFFINS IN WAX REMOVED BY SOLVENT DEWAXING AND SILICALITE TRIM DEWAXING

| | Weight % | | | |
|---|---|---|---|---|
| | Solvent (MEK/MIBK) | | Silicalite | |
| $C_{14}$ | | | 0.124 | |
| $C_{15}$ | | | 0.311 | |
| $C_{16}$ | 0.101 | | 0.773 | |
| $C_{17}$ | 0.263 | 24.324% | 2.049 | 42.505% |
| $C_{18}$ | 1.456 | | 5.364 | |
| $C_{19}$ | 6.433 | | 12.900 | |
| $C_{20}$ | 16.071 | | 20.984 | |
| $C_{21}$ | 24.539 | | 23.402 | |
| $C_{22}$ | 22.922 | | 17.447 | |
| $C_{23}$ | 14.543 | | 9.666 | |
| $C_{24}$ | 7.251 | 75.676% | 4.383 | 57.495% |
| $C_{25}$ | 3.575 | | 1.723 | |
| $C_{26}$ | 1.749 | | 0.619 | |

TABLE V-continued

| DISTRIBUTION OF N-PARAFFINS IN WAX REMOVED BY SOLVENT DEWAXING AND SILICALITE TRIM DEWAXING | | |
|---|---|---|
| | Weight % | |
| | Solvent (MEK/MIBK) | Silicalite |
| $C_{27}$ | 1.098 | 0.255 |

Example 4 —Basestock Quality Formulated Oil Performance

Figure 3:
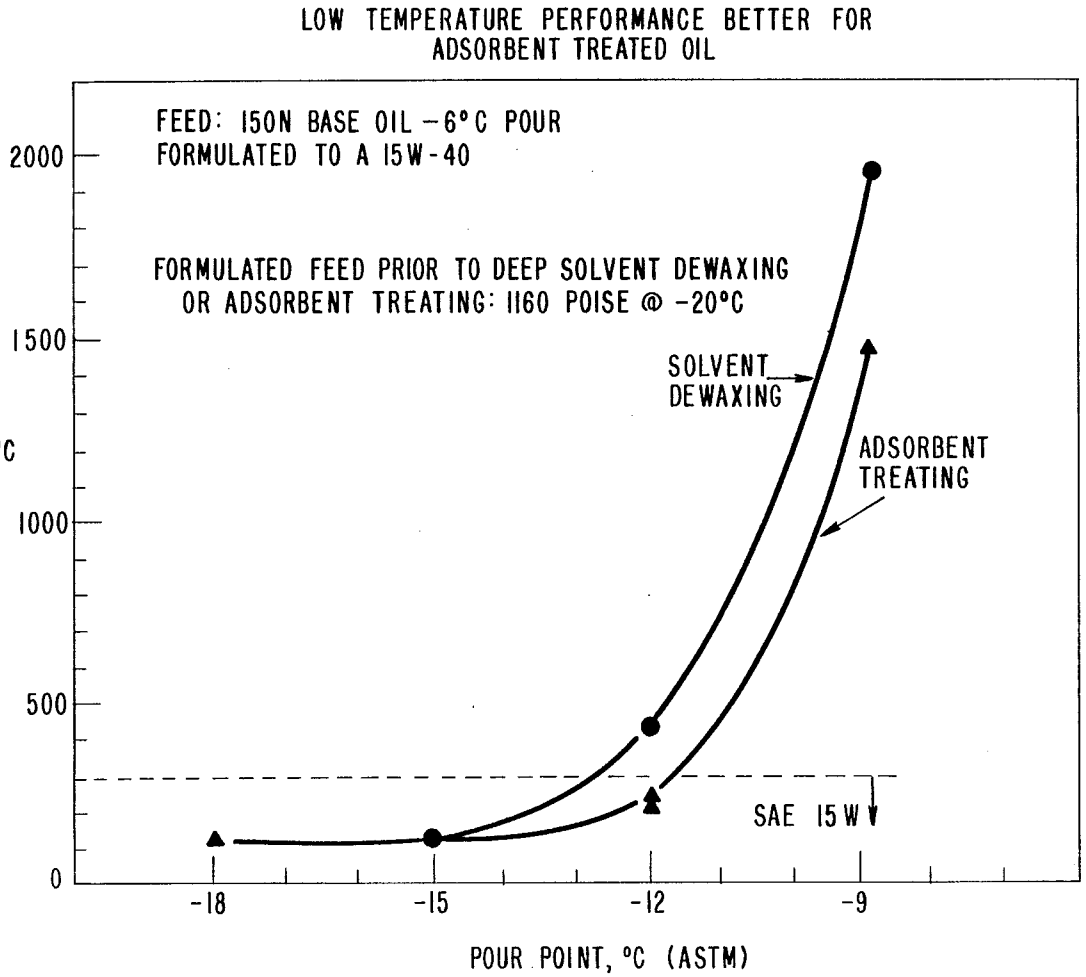
FIG. 3 shows that adsorbent treating improves the low temperature performance of formulated lube oil as compared to just solvent dewaxing.

The low temperature properties and performances of 150 N oil dewaxed to −12° C. by the procedure of the present invention, (conventional solvent dewaxing to −6° C. followed by adsorptive trim dewaxing to −12° C. using silicalite) were compared.to the properties and performance of 150 N oil dewaxed to −12° C. solely by conventional solvent dewaxing procedure practiced under severe conditions (deep dewaxing). The properties are compared in FIG. 3. In the conventional solvent dewaxing process practiced under severe conditions (deep dewaxing) the oil/solvent ratio was 1:2.5, solvent composition was 50/50 MEK/MIBK and filter temperature was 3° to 6° C. lower than the −12° C. target pour point. The two oil samples were formulated into a 15W40 product by combination with an additive package containing a detergent/inhibitor component, a low ethylene olefin copolymer (OCP) VI improver and a dialkylfumarate-vinyl acetate pour point depressant.

The conventional dewaxed oil, and the oil dewaxed by the combination of conventional dewaxing/ adsorptive trim dewaxing were formulated to a kinematic viscosity target of 15.6 cSt at 100° C. by varying the VI improver treat (but close to approximately 13.5 LV%), at a constant detergent/inhibitor treat rate of 13.5 LV%. Slow cool minirotary viscometry at −20° C. were then obtained on the formulated oil samples.

The conventionally treated oil plus adpack formulation exhibited a test viscosity at −20° C. of 400 poise, while the oil treated by the procedure of the present invention (conventional dewaxing to −6° C. pour point followed by silicalite trim dewaxing down to −12° C. pour point) plus adpack exhibited a test viscosity at −20° C. of 183 poise. The feedstock oil dewaxed to −6° C., prior to either deep dewaxing using solvent or trim dewaxing using silicalite adsorbents, when formulated with the adpack exhibited a viscosity at −20° C. of 1160 poise.

The Slow Cool MRV procedure is practiced as follows. The SCMRV setup consists of a refrigerated methanol bath, a standard MRV block (with cells and thermocouple) a Micricon microprocessor/controller and a solenoid to control coolant flow to the MRV. The microprocessor controls the solenoid, adjusting coolant flow to maintain the MRV block at the programmed temperature profile (monitored via the thermocouple). In practice the methanol source is kept at a temperature 10 to 15° C. below the final MRV test temperature. An example of the programmed cooling cycle (including sample preheat) is presented in Table A.

TABLE A

| TEMPERATURE PROFILE TP-I SLOW COOL MRV | | | |
|---|---|---|---|
| Elapsed Time (Hrs:Min.) | Temperature °C. | Allowable Variation (+/− °C.) | Comments |
| 0:20 | +80 | 1.0 | Sample Preheat |
| 2:20 | +80 | 1.0 | |
| 2:40 | 0 | 1.0 | |
| 2:43 | −3 | 0.5 | |
| 2:50 | −4.0 | 0.2 | |
| 3 | −5.0 | 0.2 | |
| 5 | −6.0 | 0.2 | |
| 7 | −7.0 | 0.2 | |
| 9 | −8.0 | 0.2 | |
| 12 | −9.0 | 0.2 | |
| 15 | −10.0 | 0.2 | |
| 18 | −11.0 | 0.2 | |
| 21 | −12.0 | 0.2 | |
| 24 | −13.0 | 0.2 | |
| 27 | −14.0 | 0.2 | |
| 30 | −15.0 | 0.2 | |
| 33 | −16.0 | 0.2 | |
| 36 | −17.0 | 0.2 | |
| 39 | −18.0 | 0.2 | |
| 42 | −19.0 | 0.2 | |
| 45 | −20.0 | 0.2 | Hold for 15W's |
| 45:24 | −21.0 | 0.2 | |
| 45:48 | −22.0 | 0.2 | |
| 46:12 | −23.0 | 0.2 | |
| 46:36 | −24.0 | 0.2 | |
| 47:00 | −25.0 | 0.2 | Hold for 10W's |
| 47:24 | −26.0 | 0.2 | |
| 47:48 | −27.0 | 0.2 | |
| 48.12 | −28.0 | 0.2 | |
| 48:36 | −29.0 | 0.2 | |
| 49:00 | −30.0 | 0.2 | Hold for 5W's |

What is claimed is:

1. A process for producing a formulated dewaxed lube or specialty oil product wherein a waxy hydrocarbon oil stock is dewaxed in a first dewaxing procedure employing solvent dewaxing or catalytic dewaxing to produce a dewaxed oil having a pour point on the order of about −3° C to −10° C. deeply dewaxing this oil in a second dewaxing procedure to yield an oil stock having a pour point of between −12° C. to −40° C., the second dewaxing procedure comprising contacting the dewaxed oil from the first dewaxing step with a hydrophobic molecular sieve adsorbent, and finally combining said deeply dewaxed oil with an effective amount of an additive package comprising detergent inhibitor components, VI improves and pour point depressants to yield the formulated oil product.

2. The process of claim 1 wherein the hydrophobic molecular sieve is a crystalline, non-polar, non-acidic material having a pore diameter of about 5 to 7 Å.

3. The process of claim 1 wherein the hydrophobic molecular sieve is silicalite.

4. The process of claim 2 wherein the hydrophobic molecular sieve is silicalite.

5. The process of claim 1 wherein the contacting of the dewaxed oil from the first dewaxing step with the hydrophobic molecular sieve adsorbent is performed at between about 25° C. to 250° C.

6. The process of claim 3 wherein the contacting of the dewaxed oil from the first dewaxing step with the hydrophobic molecular sieve adsorbent is performed at between about 25° C. to 250° C.

7. The process of claim 1 comprising the further step of regenerating the adsorbent after contacting with the oil by separating the adsorbent from the oil, stripping the adsorbent of any trapped oil, and regenerating the adsorbent by washing the adsorbent with a dewaxing solvent at a temperature of about 25° C. to 250° C.

8. The process of claim 7 wherein trapped oil is stripped from the adsorbent using nitrogen or steam purge.

9. The process of claim 7 wherein the dewaxing solvent used to regenerate the adsorbent is selected from ketones, alcohols, ethers and mixtures thereof which solvents have kinetic molecular diameters smaller than the average pore diameter of the adsorbent.

10. The process of claim 7 further comprising the step of separating the absorbent from the regenerating dewaxing solvent and drying the resultant regenerated adsorbent.

11. A process for producing a formulated dewaxed lube or specialty oil product wherein a waxy hydrocarbon oil stock is dewaxed in a first dewaxing procedure employing solvent dewaxing or catalytic dewaxing to produce a dewaxed oil having a pour point on the order of about −3° C. to −20° C, deeply dewaxing this oil in a second dewaxing procedure to yield an oil stock having a pour point of between −12° C. to −40° C., the second dewaxing procedure comprising contacting the dewaxed oil from the first dewaxing step with a silicalite sieve adsorbent, and finally combining said deeply dewaxed oil with an effective amount of an additive package comprising detergent inhibitor components, IV improvers and pour point depressants to yield the formulated oil product.

12. The process of claim 11 wherein the contacting of the dewaxed oil from the first dewaxing step with the silicalite molecular sieve adsorbent is performed at between about 25° C., to 250° C.

13. The process of claim 11 comprising the further step of regenerating the absorbent after contacting with the oil by separating the adsorbent from the oil, stripping the absorbent of any trapped oil, and regenerating the absorbent by washing the adsorbent with a dewaxing solvent at a temperature of about 25° C. to 250° C.

14. The process of claim 13 wherein trapped oil is stripped from the adsorbent using nitrogen or steam purge.

15. The process of claim 13 wherein the dewaxing solvent used to regenerate the adsorbent is selected from ketones, alcohols, ethers, and mixtures thereof which solvents have kinetic molecular diameters smaller than the average pore diameter of the silicalite adsorbent.

16. The process of claim 13 further comprising the step of separating the silicalite adsorbent from the regenerating dewaxing solvent and drying the resultant regenerated adsorbent.

* * * * *